US008585387B2

(12) United States Patent
Oyamada et al.

(10) Patent No.: US 8,585,387 B2
(45) Date of Patent: Nov. 19, 2013

(54) MANUFACTURING APPARATUS FOR NONWOVEN FABRIC

(75) Inventors: Mai Oyamada, Kariya (JP); Hiroshi Koyama, Tajimi (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 105 days.

(21) Appl. No.: 13/282,986

(22) Filed: Oct. 27, 2011

(65) Prior Publication Data

US 2012/0114779 A1 May 10, 2012

(30) Foreign Application Priority Data

Nov. 9, 2010 (JP) ..... 2010-250859

(51) Int. Cl.
*D01D 5/08* (2006.01)

(52) U.S. Cl.
USPC ..... 425/66; 425/223

(58) Field of Classification Search
USPC ..... 425/223, 66
See application file for complete search history.

(56) References Cited

U.S. PATENT DOCUMENTS 2,976,580 A * 3/1961 Riedel ..... 19/150
2006/0000070 A1* 1/2006 Mooshammer ..... 28/102
2011/0285065 A1 11/2011 Koyama

FOREIGN PATENT DOCUMENTS

JP 04-257362 9/1992

* cited by examiner

*Primary Examiner* — Ryan Ochylski
(74) *Attorney, Agent, or Firm* — Greenblum & Bernstein, P.L.C.

(57) ABSTRACT

A nonwoven fabric manufacturing apparatus has a spinning portion that spins fiber and an air delivery portion that blows air toward fiber spun out of the spinning portion. A roller is provided below the spinning portion. Fiber spun out of the spinning portion is blown onto the circumferential surface of the roller by the air blown out of the air delivery portion, so that nonwoven fabric is formed on the roller. A pair of guide plates is located below the roller. Entrained air flow is generated when the air blown out of the air delivery portion flows along the circumferential surface of the roller. Each guide plate interrupts and separates the entrained air flow from the circumferential surface of the roller.

4 Claims, 2 Drawing Sheets

MANUFACTURING APPARATUS FOR NONWOVEN FABRIC

BACKGROUND OF THE INVENTION

The present invention relates to a nonwoven fabric manufacturing apparatus for continuously manufacturing nonwoven fabric.

FIG. 2 shows an example of a related art nonwoven fabric manufacturing apparatus. The nonwoven fabric manufacturing apparatus of FIG. 2 includes a melt blow portion 31, which has a spinning portion 32 and an air delivery portion 33. The spinning portion 32 receives molten resin from an extrusion machine 35, and spins fiber F. The air delivery portion 33 receives hot air from an air blower 36, and blows the hot air toward fiber F spun out from the spinning portion 32. As a result, the spun fiber F is blown onto the flat upper surface of a conveyor belt 34 located below the melt blow portion 31, which forms sheet-like nonwoven fabric C on the conveyor belt 34.

However, the air blown out of the air delivery portion 33 creates irregular turbulence on the conveyor belt 34, which may stir up the fiber F on the conveyor belt 34. This makes manufacture of a high quality nonwoven fabric C of uniform thickness and uniform fiber density difficult.

To prevent the fibers F from being stirred up by turbulence on the conveyor belt 34, it is effective to make the conveyor belt 34 of mesh material and apply suction to the conveyor belt 34 from below. However, in this case, the obtained nonwoven fabric C can be excessively flattened or have traces of the mesh.

On the other hand, aside from the nonwoven fabric manufacturing apparatus shown in FIG. 2, the nonwoven fabric manufacturing apparatus disclosed in Japanese Laid-Open Patent Publication No. 4-257362 is known. This nonwoven fabric manufacturing apparatus has a chamber with a large area opening and a small area opening, so that the cross-sectional area of the chamber decreases from the large area opening toward the small area opening. A spinning portion and an air delivery portion are located in the large diameter opening of the chamber. Fiber spun out of the spinning portion moves into the current of air blown out of the air delivery portion, passes through the chamber, and then exits the chamber through the small area opening. A pair of rollers is provided below the small area opening, so that fiber that has exited the chamber passes between the rollers and is sent to a collecting surface of a screen belt. Accordingly, sheet-like nonwoven fabric C is formed on the collecting surface.

In the case of the nonwoven fabric manufacturing apparatus of Japanese Laid-Open Patent Publication No. 4-257362, fiber that has exited the chamber through the small area opening passes between the rollers, and is then sent to the collecting surface. Therefore, even if the air from the air delivery portion creates turbulence, fiber is unlikely to be stirred up from the collecting surface. However, the nonwoven fabric manufacturing apparatus of Japanese Laid-Open Patent Publication No. 4-257362 has a disadvantageously complicated structure.

SUMMARY OF THE INVENTION

Accordingly, it is an objective of the present invention to provide a nonwoven fabric manufacturing apparatus of a simple structure that is capable of manufacture high quality nonwoven fabric.

To achieve the foregoing objective and in accordance with one aspect of the present invention, a nonwoven fabric manufacturing apparatus is provided that includes a melt blow portion, a roller, and a pair of guide plates. The melt blow portion has a spinning portion that spins fiber and an air delivery portion that blows air toward fiber spun out of the spinning portion. The roller is provided on a downstream side of the melt blow portion. The roller rotates about its own central axis, and fiber spun out of the spinning portion is blown onto the circumferential surface of the roller by the air blown out of the air delivery portion, so that nonwoven fabric is formed on the roller. Each guide plate has an upstream end, which is located to correspond to one of downstream parts of the roller. Each of the downstream parts of the roller is a part on the circumferential surface of the roller that is downstream in the rotational direction of the roller with respect to a part of the circumferential surface of the roller on which the fiber is blown. Each guide plate interrupts and separates entrained air flow from the circumferential surface of the roller, the entrained air flow being generated when the air blown out of the air delivery portion flows along the circumferential surface of the roller. The upstream end of each guide plate is located below a horizontal plane in which the central axis of the roller lies and is parallel with a plane that is more upright than a plane tangent to a corresponding one of the downstream parts of the circumferential surface of the roller.

Other aspects and advantages of the invention will become apparent from the following description, taken in conjunction with the accompanying drawings, illustrating by way of example the principles of the invention.

DETAILED DESCRIPTION OF THE PREFERRED EMBODIMENTS

One embodiment of the present invention will now be described with reference to FIG. 1.

Figure 1:
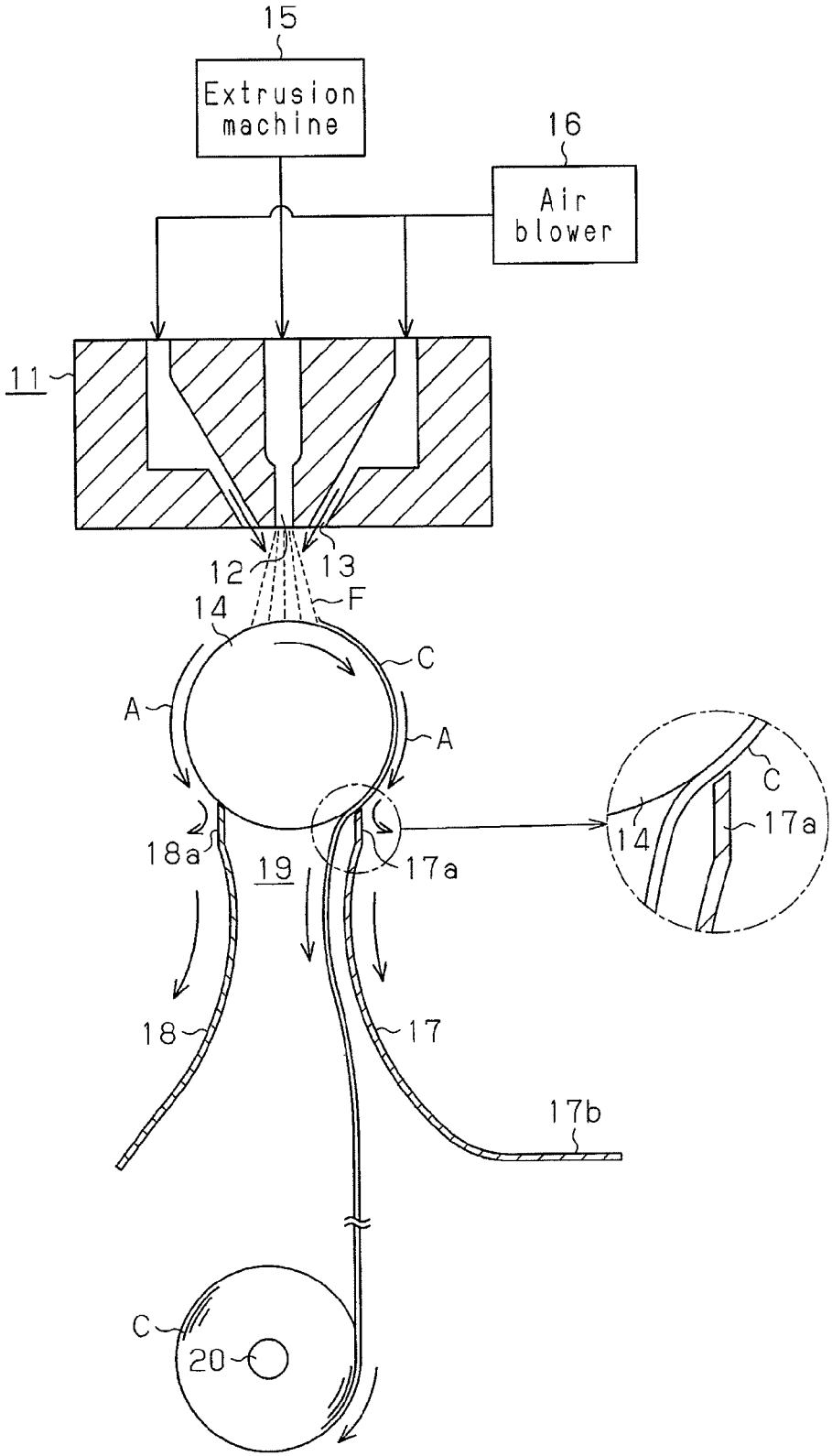
FIG. 1 is a diagram illustrating a nonwoven fabric manufacturing apparatus according to one embodiment of the present invention.
Figure 2:
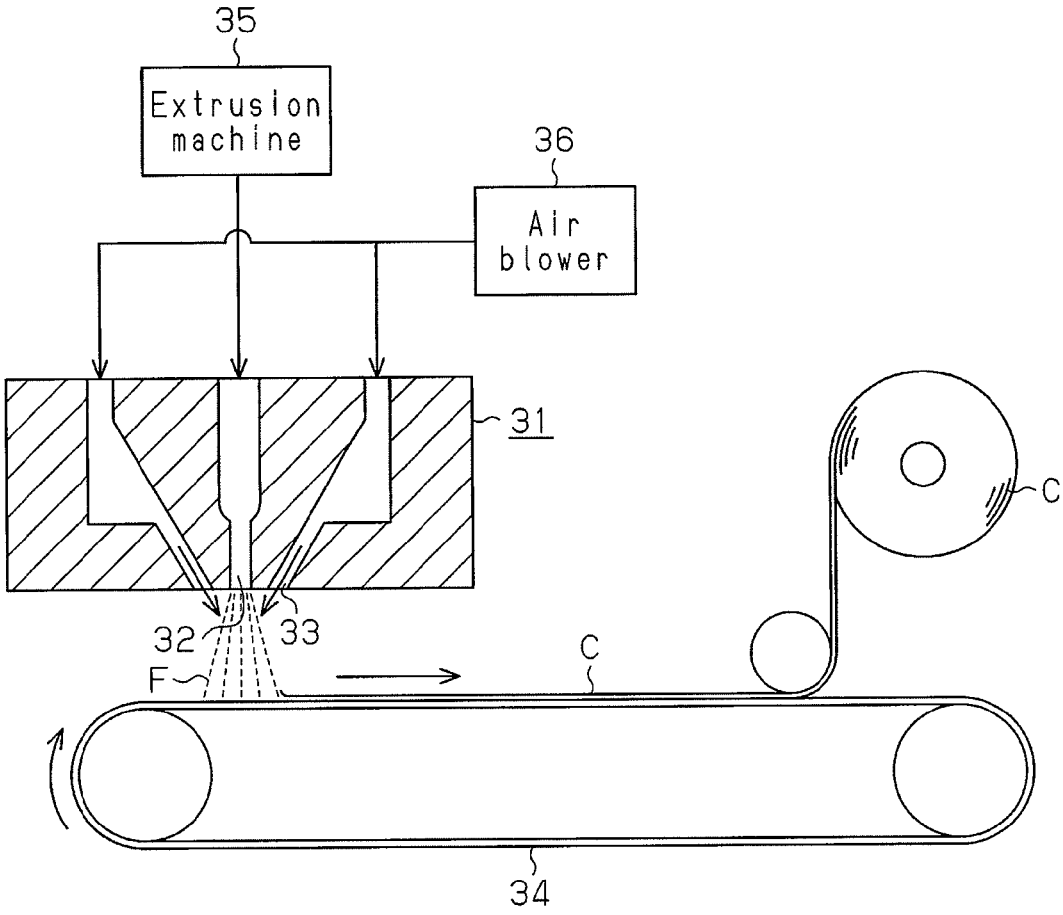
Fig.2(Related Art)
FIG. 2 is a diagram illustrating a related art nonwoven fabric manufacturing apparatus.

FIG. 1 shows a nonwoven fabric manufacturing apparatus of the present embodiment. The apparatus includes a melt blow portion 11, which has a spinning portion 12 and an air delivery portion 13. The spinning portion 12 receives molten resin from an extrusion machine 15, and spins fiber F. The air delivery portion 13 receives hot air from an air blower 16, and blows the hot air toward fiber F spun out from the spinning portion 12. As a result, the spun fiber F is blown onto the circumferential surface of a roller 14 downstream of, that is, below the melt blow portion 11, which forms sheet-like nonwoven fabric C on the roller 14. The roller 14 is rotatable about its horizontal central axis, and is separated by a predetermined distance from the distal opening of the spinning portion 12.

A pair of curved guide plates 17, 18 is located below the roller 14. The guide plates 17, 18 are separated from and face each other. The space between the guide plates 17, 18 generally increases toward the lower ends. The air blown out of the air delivery portion 13 flows downward along the circumferential surface of the roller 14 and generates entrained air flow A about the roller 14. The guide plates 17, 18 interrupt the entrained air flow A and separate the entrained flow A away from the circumferential surface of the roller 14. The space defined between the guide plates 17, 18 functions as a guide passage 19 through which the nonwoven fabric C passes.

An upper end 17*a* of the guide plate 17 and an upper end 18*a* of the guide plate 18 are located below a horizontal plane in which the central axis of the roller 14 lies. A clearance is created between the upper end 17*a* of the guide plate 17 and the circumferential surface of the roller 14. A clearance is created between the upper end 18*a* of the guide plate 18 and the circumferential surface of the roller 14. The upper end 17*a* of the guide plate 17 is not parallel with a tangent plane of a part of the circumferential surface of the roller 14 that is closest to the upper end 17*a*. Rather, the upper end 17*a* is parallel with a plane that is more upright than the tangent plane. Likewise, the upper end 18*a* of the guide plate 18 is not parallel with a tangent plane of a part of the circumferential surface of the roller 14 that is closest to the upper end 17*a*. Rather, the upper end 18*a* is parallel with a plane that is more upright than the tangent plane. In the case of the present embodiment, the upper end 17*a* of the guide plate 17 and the upper end 18*a* of the guide plate 18 are both substantially vertical and parallel with each other.

Most parts of the guide plate 17 and the guide plate 18 have the same curvature. However, while the guide plate 17 has an extended portion 17*b* extending horizontally at the lower end, the guide plate 18 has no such extended portion. That is, the guide plate 17 and the guide plate 18 have different shapes and are asymmetrical with each other. Therefore, after being blown out from the air delivery portion 13, the flow of air is divided such that the amount of air that flows toward the guide plate 18 along the circumferential surface of the roller 14 is greater than the amount of air that flows toward the guide plate 17 along the circumferential surface of the roller 14. This is because the guide plate 18 has a shape that has a smaller flow resistance than that of the guide plate 17.

When sent to the guide passage 19 between the guide plates 17, 18 by rotation of the roller 14, the nonwoven fabric C formed on the roller 14 is peeled off the roller 14 and reeled onto a collecting portion, which is a take-up shaft 20.

Operation of the nonwoven fabric manufacturing apparatus shown in FIG. 1 will now be described.

When manufacturing nonwoven fabric using the nonwoven fabric manufacturing apparatus of FIG. 1, molten resin is supplied from the extrusion machine 15 to the spinning portion 12 while the roller 14 is rotated. Concurrently, hot air is supplied to the air delivery portion 13 from the air blower 16. Accordingly, fiber F spun from the spinning portion 12 is blown onto the circumferential surface of the rotating roller 14 by the air blown out of the air delivery portion 13. As a result, sheet-like nonwoven fabric C is formed continuously on the roller 14.

Since the roller 14 has a cylindrical shape, the air blown out of the air delivery portion 13 does not become stagnant above the roller 14, but smoothly flows downward along the circumferential surface of the roller 14. Also, since the guide plates 17, 18 below the roller 14 are asymmetrical with each other, the air blown out of the air delivery portion 13 flows along the circumferential surface of the roller 14 preferentially toward the guide plate 18, which has a smaller flow resistance. Therefore, no turbulence is created above the roller 14, and the fiber F is not stirred up by turbulence, and nonwoven fabric is formed without hindrance. In contrast, if the guide plates 17, 18 had shapes that were symmetrical with respect to one another, air blown out of the air delivery portion 13 would not flow smoothly, and would adversely affect the formation of nonwoven fabric.

As the roller 14 rotates, nonwoven fabric C formed on the roller 14 is sent to the guide passage 19 via the clearance between the roller 14 and the upper end 17*a* of the guide plate 17. At this time, the entrained air flow A is interrupted by the guide plates 17, 18 and does not enter the guide passage 19.

After reaching to the guide passage 19, the nonwoven fabric C is peeled off the roller 14 and reeled onto the take-up shaft 20. Since the entrained air flow A is interrupted by the guide plates 17, 18 and does enter the guide passage 19, the nonwoven fabric C is not adversely affected by the entrained air flow A in the guide passage 19.

Accordingly, the present embodiment has the following advantages.

According to the nonwoven fabric manufacturing apparatus of FIG. 1, the fiber F spun from the spinning portion 12 is blown onto the circumferential surface of the roller 14 by the air blown out of the air delivery portion 13. The air blown out of the air delivery portion 13 does not become stagnant above the roller 14, but smoothly flows downward along the circumferential surface of the roller 14, so that the fiber F is not stirred up on the roller 14 by turbulence. This permits a high quality nonwoven fabric C of uniform thickness and uniform fiber density to be manufactured.

The air blown out of the air delivery portion 13 flows downward along the circumferential surface of the roller 14 and generates entrained air flow A about the roller 14. Since the entrained air flow A is interrupted by the guide plates 17, 18, the entrained air flow A does not enter the guide passage 19. Therefore, when the nonwoven fabric C is peeled off the roller 14 in the guide passage 19, the entrained air flow A does not influence. This also permits a high quality nonwoven fabric C of uniform thickness and uniform fiber density to be manufactured.

The guide plates 17, 18, which are provide as means for preventing adverse influence of the entrained air flow A, have relatively simple structures and do not significantly complicate the structure of the nonwoven fabric manufacturing apparatus.

The upper end 17*a* of the guide plate 17 is not parallel with a tangent plane of a part of the circumferential surface of the roller 14 that is closest to the upper end 17*a*. Rather, the upper end 17*a* is parallel with a plane that is more upright than the tangent plane. Compared to a case in which the upper end 17*a* of the guide plate 17 is parallel with the tangent plane, it is possible to more effectively prevent entrained air flow A from entering the guide passage 19 through the clearance between the upper end 17*a* of the guide plate 17 and the circumferential surface of the roller 14.

The upper end 18*a* of the guide plate 18 is not parallel with a tangent plane of a part of the circumferential surface of the roller 14 that is closest to the upper end 18*a*. Rather, the upper end 18*a* is parallel with a plane that is more upright than the tangent plane. Compared to a case in which the upper end 18*a* of the guide plate 18 is parallel with the tangent plane, it is possible to more effectively prevent entrained air flow A from entering the guide passage 19 through the clearance between the upper end 18*a* of the guide plate 18 and the circumferential surface of the roller 14.

Since the guide plates 17, 18 are asymmetrical with each other, the air blown out of the air delivery portion 13 flows along the circumferential surface of the roller 14 preferentially toward the guide plate 18, which has a smaller flow resistance. This further reduces the possibility of turbulence generated by air blown out of the air delivery portion 13.

While the central axis of the roller 14 extends horizontally, the upper ends 17*a*, 18*a* of the guide plates 17, 18 are located below a horizontal plane in which the central axis of the roller 14 lies and is parallel with a vertical plane. This further effectively prevents the entrained air flow A from entering the guide passage 19.

The above embodiment may be modified as follows.

The extended portion 17*b* of the guide plate 17 is means for causing the air blown out of the air delivery portion 13 to flow along the circumferential surface of the roller 14 preferentially toward the guide plate 18. Instead of forming the extended portion 17*b* on the guide plate 17, the over all sizes or the curvatures may be different between the guide plate 17 and the guide plate 18. Alternatively, instead of making the guide plates 17, 18 with different shapes, the positions relative to the roller 14 may be different between the guide plate 17 and the guide plate 18.

In the above illustrated embodiment, a clearance is formed between the upper end 18*a* of the guide plate 18 and the circumferential surface of the roller 14. However, the upper end 18*a* of the guide plate 18 may contact the circumferential surface of the roller 14. In this case, to prevent the roller 14 from being damaged, the upper end 18*a* of the guide plate 18 is preferably formed of a material softer than the circumferential surface of the roller 14. If the upper end 18*a* of the guide plate 18 is caused to contact the circumferential surface of the roller 14, fiber that remains adhering to the circumferential surface can be scraped off by the upper end 18*a*.

In the illustrated embodiment, the upper end 17*a* of the guide plate 17 and the upper end 18*a* of the guide plate 18 are parallel with each other. However, the upper end 17*a* and the upper end 18*a* may be nonparallel such that the distance therebetween decreases toward the upper edges. This further effectively prevents the entrained air flow A from entering the guide passage 19.

In the illustrated the embodiment, the take-up shaft 20 is located substantially at a middle position between the guide plate 17 and the guide plate 18. However, the take-up shaft 20 may be located closer to the guide plate 17 than to the guide plate 18. In this case, since the amount of part of the air blown out of the air delivery portion 13 that flows along the circumferential surface of the roller 14 toward the guide plate 17 is relatively small, the entrained air flow A is effectively prevented from influencing the collection of the nonwoven fabric C by the take-up shaft 20.

What is claimed is:

1. A nonwoven fabric manufacturing apparatus comprising:

a melt blow portion having a spinning portion that spins fiber and an air delivery portion that blows air toward fiber spun out of the spinning portion;

a roller having a circumferential surface and a central axis, and being provided on a downstream side of the melt blow portion, wherein the roller is rotatable about the central axis, and when the fiber is spun out of the spinning portion and blown onto the circumferential surface of the roller by the air blown out of the air delivery portion, nonwoven fabric is formed on the roller; and a pair of guide plates provided on opposite sides of the central axis of the roller, each guide plate having an upstream end located at a part of the circumferential surface of the roller that is downstream in a rotational direction of the roller with respect to a part of the circumferential surface of the roller on which the fiber is blown, wherein the spinning portion is located above the roller, the central axis of the roller extends horizontally, and the upstream ends of the guide plates are parallel with one of a vertical plane or with a plane that is inclined inward relative to the vertical plane toward the central axis, wherein each guide plate is configured to interrupt and separate entrained air flow from the circumferential surface of the roller, the entrained air flow being generated when the air blown out of the air delivery portion flows along the circumferential surface of the roller, and wherein the upstream end of each guide plate is located below a horizontal plane in which the central axis of the roller lies and is parallel with a plane that is more upright than a plane tangent to a corresponding one of the downstream parts of the circumferential surface of the roller.

2. The nonwoven fabric manufacturing apparatus according to claim 1, wherein the guide plates are asymmetrical with respect to each other such that air blown out of the air delivery portion flows along the circumferential surface of the roller toward one of the guide plates.

3. The nonwoven fabric manufacturing apparatus according to claim 2, further comprising a collecting portion for collecting the nonwoven fabric formed on the roller, wherein the collecting portion is located closer to the guide plate that is not the one guide plate toward which air blown out of the air delivery portion flows.

4. The nonwoven fabric manufacturing apparatus according to claim 1, wherein one of the upstream ends of the guide plates is located downstream with respect to the rotational direction of the roller and contacts the circumferential surface of the roller.

* * * * *